US006021900A

United States Patent [19]

Jordan

[11] Patent Number: 6,021,900

[45] Date of Patent: Feb. 8, 2000

[54] TOMB BASKET

[76] Inventor: Randy D. Jordan, 1532 County Rd. 28, Clanton, Ala. 35046

[21] Appl. No.: 09/303,924

[22] Filed: May 3, 1999

[51] Int. Cl.[7] ..... B65D 1/38

[52] U.S. Cl. ..... 206/457; D99/25; 217/124; 217/125; 428/3

[58] Field of Search ..... D3/238; D99/25; 27/1; 150/127, 129, 130; 206/19, 457; 217/123–125; 220/661; 312/33; 428/3; 426/104

[56] References Cited

U.S. PATENT DOCUMENTS

| | | | |
|---|---|---|---|
| 97,836 | 12/1869 | Venet . | |
| 107,446 | 9/1870 | Carman et al. | 217/124 |
| 125,706 | 4/1872 | Venet . | |
| D. 355,865 | 2/1995 | Stingley | D99/25 |
| 372,345 | 11/1887 | Valfer et al. | 206/457 |
| D. 385,081 | 10/1997 | Parker | D99/25 |
| D. 388,732 | 1/1998 | Campbell | D99/25 |
| D. 388,733 | 1/1998 | Campbell | D99/25 |
| D. 396,930 | 8/1998 | Snipes, Jr. | D99/25 |
| D. 400,467 | 11/1998 | Campbell | D99/25 |
| 4,866,863 | 9/1989 | Scarcello et al. | 428/3 |
| 5,582,883 | 12/1996 | Keshishian | 428/3 |

*Primary Examiner*—Jim Foster
*Attorney, Agent, or Firm*—Wm. Randall May

[57] ABSTRACT

A repository device, useful as a collection container, a religious instructional tool and a religious decorative item is disclosed. The repository device consists of a completely enclosed, ovoid-shaped basket having a conventional handle and having a moveable side entry closure in the top portion of the basket. The entry closure is designed to assimilate an ancient tombstone used in ancient times to seal burial tombs.

12 Claims, 2 Drawing Sheets

TOMB BASKET

BACKGROUND OF THE INVENTION

This invention relates generally to repository devices such as baskets and the like. More specifically, this invention relates to a uniquely designed basket, the features and construction of which allow the device to be used as a religious instructional aid, as a decorative item for religious holidays, or functionally, as a collection basket. The basket design of the present invention may take various forms and may be constructed of virtually any material, however, for weight and convenience considerations, a basket of reticular design constructed of plastic or wicker is preferred.

Reticular baskets constructed of wicker or plastic are not new to the art and have been in existence in various forms for many years. The present invention is a modification and improvement over prior art designs and incorporates unique features which allow the basket to be used, not only as a repository device, but also as a religious instructional tool and decorative item for use with certain religious holidays or ceremonies such as the Easter holiday of the Christian religion.

SUMMARY OF THE INVENTION

In view of the foregoing, it is a primary object of this invention to provide a uniquely designed repository device in the form of a basket having features which allow the device to be used as a religious instructional aid and decorative item and also as a collection repository.

According to an embodiment of the invention, a repository device comprises a completely enclosed, ovoid-shaped, reticular basket having a conventional handle and a moveable side entry closure or door in the top portion of the basket.

An advantage of the present invention is the provision of an ovoid-shaped reticular basket which can be used as a religious instructional tool.

Another advantage of the present invention is the provision of an ovoid-shaped reticular basket which can be used as a religious decorative item.

A further advantage of the present invention is the provision of an ovoid-shaped reticular basket having a moveable closure device or door which assimilates an ancient tombstone.

Another advantage of the present invention resides in the resemblance of the device to the ancient Biblical resurrection tomb of Jesus.

A further advantage of the present invention is that the device is also designed to be used functionally as a collection basket for gathering eggs and the like.

BRIEF DESCRIPTION OF THE DRAWINGS

The foregoing and other objects, features, and advantages of the present invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

DETAILED DESCRIPTION OF THE DRAWINGS

Figure 1:
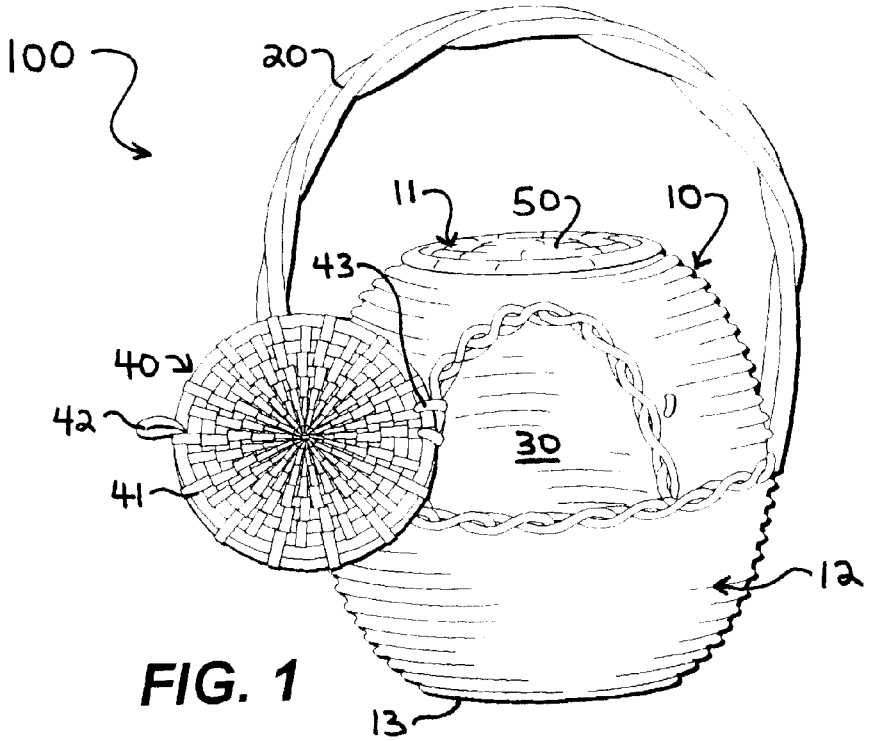
FIG. 1 is a perspective, front elevational view of an embodiment of the invention showing the device with its moveable "tomb door" in the open position.
Figure 2:
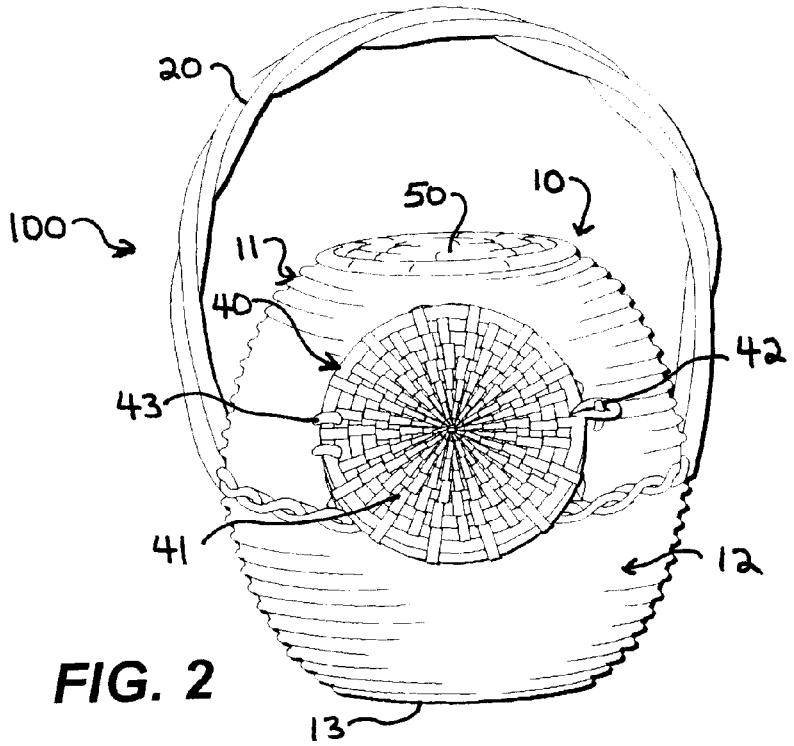
FIG. 2 is a perspective, front elevational view of the embodiment of FIG. 1 showing the invention with its moveable "tomb door" in the closed position.

In accordance with an embodiment of the invention, FIGS. 1–4 show a repository device 100 comprising an enclosed, ovoid-shaped basket means 10 having a handle means 20, a side entry opening 30 and a moveable closure means 40.

In a preferred embodiment of the device 100, the basket means 10 is of reticular construction having an upper portion 11 and a lower portion 12. The upper portion 11 of said basket means 10 is essentially elliptical in shape and houses the side entry opening 30. The lower portion 12 of said basket means 10 completes the overall ovoid shape of the device 100 and further comprises a flat bottom 13 for stability. Wicker or plastic is the preferred design material for the reticular weave construction of the basket means 10. The handle means 20 is of conventional shape and may be of singular or multiple weave-type construction and attaches to either side of the ovoid-shaped basket means 10 as shown. The side entry opening 30 is elliptically-shaped and is positioned in the upper portion 11 of the basket means 10 so as to be central to, and parallel with, the positioning of the handle means 20 to either side of said basket means 10. The moveable closure means 40 comprises a round door 41, preferably of reticular weave, which is hingeably, or otherwise moveably, attached to one side of said side entry opening 30. A hinge means 43 is attached to one side of said door 41 and, adjacently, to said basket means 10 in a manner which will allow the door 41 to be easily swung from a closed position to an open position with respect to said side entry opening 30. In an alternate embodiment, the hinge means 43 may comprise a pin or axle, situated at one side edge of said door 41, which would allow the door 41 to be opened by rotating the door 41 in a circular, clockwise or counterclockwise, motion with respect to said side entry opening 30. The door 41 may also be slidably attached to said basket means 10 in a manner which would allow the door 41 to be moved linearly, as by rolling or sliding, between an open position and a closed position with respect to said side entry opening 30. A simple latch means 42 may be attached to said door 41 for securing the door 41 to the basket means 10 when the door 41 is in a closed position.

In an alternate embodiment, the top of the basket means 10 comprises a moveable or removable lid means 50. Said lid means 50 would create another opening into the basket 10 thereby allowing items to be placed into, and removed from, the basket 10 in a more conventional manner.

Figure 3:
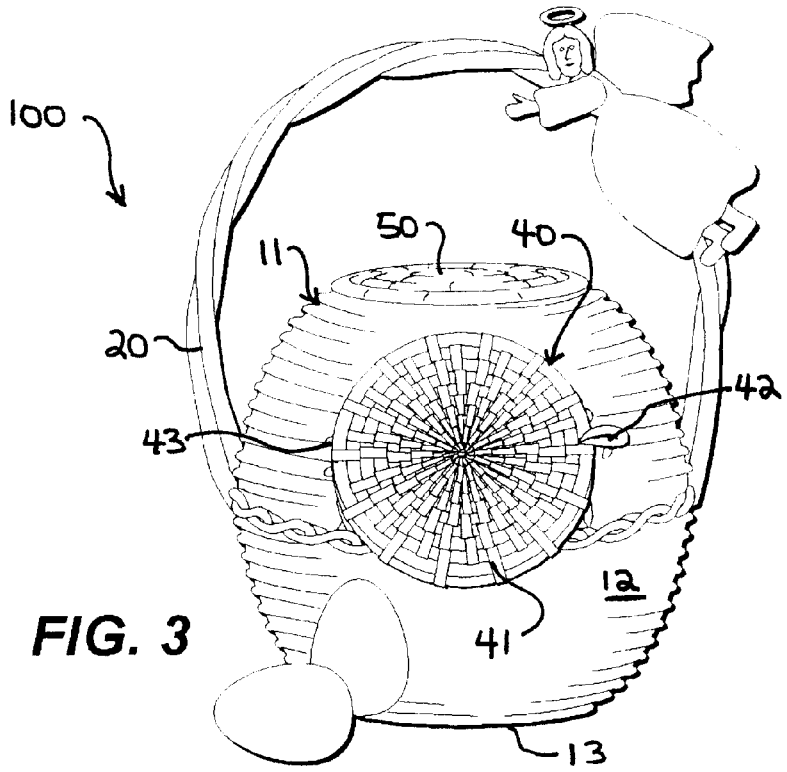
FIG. 3 is a perspective, front elevational view of the embodiment of FIG. 1 showing the invention being used as a religious decorative item.
Figure 4:
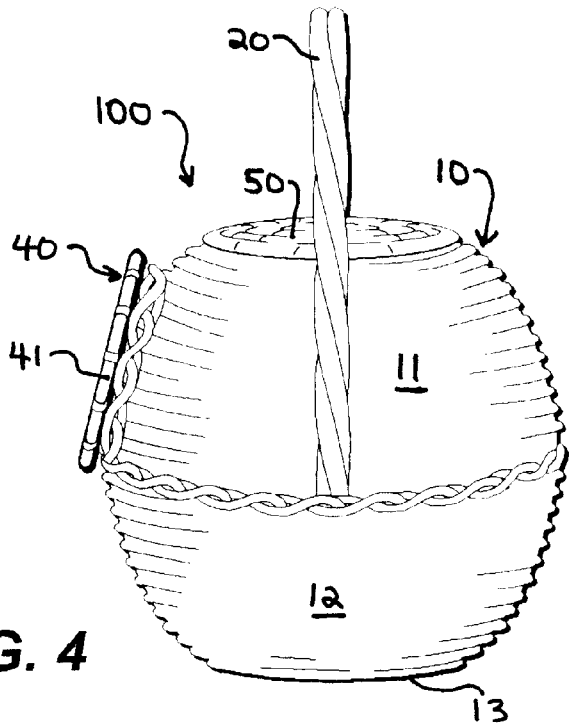
FIG. 4 is a perspective elevational side view of the embodiment of FIG. 2.

In addition to its use as a repository, the device 100 may be used as a religious instructional tool for Bible studies or any activity relating to the Biblical resurrection of Jesus. The device 100 may also be used, as shown in FIG. 3, as a decorative item for religious ceremonies or holidays.

While the invention has been particularly shown and described with reference to the preferred embodiments thereof, it will be understood by those skilled in the art that various alterations in form, detail and construction may be made therein without departing from the spirit and scope of the invention.

The embodiments of the invention in which an exclusive property right or privilege is claimed are defined as follows:

1. A repository device, useful as a collection container, a religious instructional aid and a religious decorative item comprising:

a completely enclosed, ovoid-shaped, basket having an upper portion and a lower portion and having a handle member attached to the upper portion of said basket and further having a side entry opening with a moveable closure member attached thereto.

2. The apparatus of claim 1, wherein said basket is of reticular construction.

3. The apparatus of claim 1, wherein said side entry opening is positioned on said upper portion of said basket and has an elliptical shape.

4. The apparatus of claim 1, wherein said moveable closure member comprises a round door hingeably attached to said basket, at or near said side entry opening, in a manner which substantially covers said side entry opening when the door is in a closed position.

5. The apparatus of claim 1, wherein said moveable closure member comprises a round door rotatably attached to said basket, at or near the side entry opening, in a manner which will allow the door to be rotated in a circular motion to cover or uncover said side entry opening.

6. The apparatus of claim 1, wherein said moveable closure member comprises a round door slidably attached to said basket, at or near said side entry opening, in a manner which will allow the door to be linearly moved, as by rolling or sliding, between an open position and a closed position with respect to said side entry opening.

7. The apparatus of claim 1, wherein said handle member comprises a single arcuate member which is attached at either side of said basket.

8. The apparatus of claim 1, wherein said handle member comprises two or more arcuate members which are attached at either side of said basket.

9. The apparatus of claim 1, wherein said side entry opening is positioned on said upper portion of said basket so as to be central to, and parallel with, the positioning and attachment of said handle member to said basket.

10. The apparatus of claim 1, wherein said moveable closure member assimilates an ancient tombstone used in Biblical times to seal burial tombs.

11. The apparatus of claim 1, wherein the top of said upper portion of said repository device further comprises a moveable or removable lid.

12. The apparatus of claim 1, wherein the design of said repository device is made to resemble the ancient Biblical tomb of Jesus.

* * * * *